United States Patent [19]

Soulard et al.

[11] Patent Number: 5,070,286

[45] Date of Patent: Dec. 3, 1991

[54] MANIPULATOR FOR PUBLIC WORKS MACHINES AND MACHINE EQUIPPED WITH SUCH MANIPULATOR FOR ROAD WORKS

[75] Inventors: Paul Soulard, Brissac; Paul Chassaing; Georges Moreau, both of Angers, all of France

[73] Assignee: Laboratoire Central des Ponts et Chaussees, Paris, France

[21] Appl. No.: 437,357

[22] Filed: Nov. 15, 1989

[30] Foreign Application Priority Data

Nov. 15, 1988 [FR] France ..... 88 14828

[51] Int. Cl.[5] ..... E02F 5/30

[52] U.S. Cl. ..... 318/568.1; 318/652; 37/DIG. 1; 414/694; 414/699

[58] Field of Search ..... 318/560–640, 318/652; 364/424.07; 414/680–734; 901/1, 2, 3, 9, 15, 17–20; 37/193, 98, DIG. 1, DIG. 16; 405/157, 160, 174, 175, 177, 180, 181, 182, 183

[56] References Cited

U.S. PATENT DOCUMENTS

| | | | |
|---|---|---|---|
| 3,495,509 | 2/1970 | Lusk . | |
| 3,866,384 | 2/1975 | Peterson, Jr. . | |
| 4,059,196 | 11/1977 | Uchino et al. | 414/699 |
| 4,332,517 | 6/1982 | Igarashi et al. | 414/728 X |
| 4,377,043 | 3/1983 | Inui et al. | 37/DIG. 1 X |
| 4,430,022 | 2/1984 | Kinnan . | |
| 4,677,555 | 6/1987 | Goyet | 37/DIG. 1 X |
| 4,682,427 | 7/1987 | Dondi | 37/91 |
| 4,706,001 | 11/1987 | Nakashima et al. | 901/50 X |
| 4,826,391 | 5/1989 | Lawrence et al. | 414/699 X |
| 4,829,418 | 5/1989 | Nielsen et al. | 37/DIG. 1 X |
| 4,866,641 | 9/1989 | Nielsen et al. | 414/699 X |
| 4,888,890 | 12/1989 | Studebaker et al. | 414/694 X |
| 4,889,466 | 12/1989 | Jindai et al. | 414/694 |
| 4,896,997 | 1/1990 | Gaylin | 405/174 X |

FOREIGN PATENT DOCUMENTS

| | | |
|---|---|---|
| 2387322 | 4/1978 | France . |
| 2403968 | 9/1978 | France . |

*Primary Examiner*—Paul Ip

*Attorney, Agent, or Firm*—Brumbaugh, Graves, Donohue & Raymond

[57] ABSTRACT

A manipulator arm is provided for public works machines comprising two beams of equal length and a pivoting cradle connected in series. The first or command beam is rotated about the forward end thereof on the chassis of a support unit, and the cradle is pivoted in response to rotation of the command beam by means of gears and chains designed and arranged such that the cradle undergoes a linear translational movement and maintains a predetermined inclination.

11 Claims, 7 Drawing Sheets

MANIPULATOR FOR PUBLIC WORKS MACHINES AND MACHINE EQUIPPED WITH SUCH MANIPULATOR FOR ROAD WORKS

FIELD OF THE INVENTION

The present invention relates to a manipulator for public works machines as well as to a machine equipped with such a manipulator, particularly for use in the prefracturing of lower strata or coatings of roads treated with hydraulic binder.

BACKGROUND OF THE INVENTION

The invention pertains to a manipulator comprising at least one arm or pivot beam of which one end is articulated on a support machine and of which the other end is equipped with a tool adapted to pivot about the axis of that end of the manipulator, as well as control means such as hydraulic or pneumatic cylinders or motors, cables, chains etc., affording positioning of the manipulator and of the tool.

Conventional manipulators generally require a considerable skill on the part of the machine operator, particularly when the point or edge of the tool must be maintained at a desired level or follow a curve of predetermined shape over a relatively long tool path and preferably over the maximum possible path of the tool.

Known manipulators therefore cannot be operated by an unskilled or semi-skilled worker and do not afford automation of operation.

It is an object of the present invention to alleviate these disadvantages and to provide a manipulator, in particular for public works machine, which can be operated by an unskilled person and affords automation.

This object is attained according to the present invention by a manipulator which comprises two beams of which a first beam, called the command beam is articulated firstly, at its rear end, on a pivot shaft which is fixed to the chassis of a support machine and secondly at its forward end, about the rear end of the second beam, called the follower beam, by means of a common pivot shaft. The forward end of the follower beam is provided with a cradle mounted thereon by means of a pivot shaft. The command beam is made to pivot about its rear pivot axis by means of a rotational or linear motor. Each of the two beams includes a detector means for detecting the pivot angle of the respective beam, a pivot motor provided at the forward end of the beam and adapted to cause the pivoting either of the rear end of the follower beam or of the cradle, as well as transmission means provided between the detector means and the pivot motor of each beam for controlling the pivoting either of the follower beam or of the cradle as a function of the degree of rotation either of the command beam or of the follower beam detected by the detector means of the corresponding beam.

By virtue of the foregoing arrangement an operator need only control the angle of incline of the command beam in order automatically to obtain a predetermined displacement of the cradle on which may be mounted a suitable tool.

The detector means, the pivot motor and the transmission means between the detector means and the pivot motor are advantageously mechanical elements.

In this way the detector means for each of the two beams of the manipulator may comprise a gear mounted on the pivot shaft of the rear end of the beam and stationary in rotation about the axis of that shaft. The pivot motor provided at the forward end of each beam may include another gear coupled to a pivot shaft which is fixed either to the rear end of the follower beam, or to the cradle, and the axis of which coincides with the axis of the pivot shaft either of the rear end of the follower beam or of the cradle respectively. Means linking the detector member (non-rotating gear) and the pivot motor mounted on each beam may comprise either an endless chain, which may be provided with a tensioning device, looped around the non-rotating gear and the gear of the pivot motor, or by a series of intermediate gears comprised of an odd number of gears mounted on the beam by means of shafts parallel to that of the non-rotating gear and engaging one another. In the latter case the rearmost intermediate gear engages the teeth of the non-rotating gear and the forwardmost intermediate gear cooperates with the gear of the corresponding pivot motor.

Advantageously the rear end of the command beam is mounted on the pivot pin of a first yoke or clevis which is fixed to a carriage mounted on a universal joint type support system, itself pivoted on the chassis of the support machine by means of a pivot pin parallel to that of the first yoke, motors or cyclinders being provided between the chassis and the support system, and between the chassis or the support system and the command beam.

The present invention further relates a machine for pre-fracturing lower strata or coatings of pavements treated with hydraulic binders.

In a known method of prefracturing a trough is formed in the lower strata before the final compacting phase, a product is sprayed or projected into the trough and forms a film by solidification in contact with the trough-forming material, and the trough is immediately closed and final compacting effected. The injected product which is preferably a bitumous cationic emultion of low pH and with a relatively high fracture rate, plays a double roll: by its pH aqueuse phase, it creates a low resistance zone which favours the localization of shrinkage cracks and, by its relatively high fracture rate bituminous phase, it creates a discontinuity and affords precise prelocalization of the fracture. The advantages of this method include the precise localization of the fracture, the bituminous treatment of the through faces which become insensitive to water and only slightly sensitive to abrasion, the relatively straightforward execution with negligible effects on the cohesion of the strata and a very low cost per square meter of treated pavement.

A device for carrying out such a method is also known, which comprises means for forming troughs including a V shaped plough type blade which splits the strata, means for projecting a product into the troughs including spray tips or nozzles, and means for refilling the troughs including two inverted V shaped plates.

These three means can be ridgidly mounted on a carriage slideably mounted on a rail corresponding to the width of the road or passage to be treated, and supported on a vehicle which carries a temperature controlled emultion tank and a pump, as well as connecting means for delivering the emulsion to the spray nozzles for projection into the trough. This device is however cumbersome and blocks the entire width of the pavement surface to be treated.

An object of the present invention is to provide an improved prefracturing machine which overcomes the disadvantages of known devices and which is capable of forming narrow troughs in order to limit as much as possible the upsetting of the strata of material already laid down, which does not constitute a permanent obstacle in the area of the strata being treated, which can be perfectly integrated between the other construction phases of a particular project without slowing down the execution of those phases by virtue of an entirely automated work cycle, and which is totally autonomous.

This object is attained according to the invention by a machine for prefacturing the lower strata or coatings of pavement treated with hydraulic binders which includes:

means for forming troughs, means for projecting a product into the troughs, means for refilling said troughs, and means for moving the preceding means during the operation of the machine, wherein the means for forming troughs includes a substantially vertical, tapered blade of triangular cross section of which the cutting edge is positioned in the direction of movement of the blade during the treatment of the strata; wherein the means for projecting a product into the troughs includes a manifold or spray nozzle fixed to the rear edge of said blade and connected to a holding reservoir for the treatment product by means of a pump; further wherein said means for refilling said troughs includes two scrapers flexibly mounted to the rear of said blade forming a V opening in the advancing direction of the blade; and wherein the blade, the spray manifold and the scrapers, combined to form a single tool, are mounted on the free end of a manipulator such as defined hereinabove.

Said displacement means comprise a support machine including a motor, and on which is mounted a pivoting manipulator operated by said motor and having a free end adapted to be moved horizontally in response to said motor, said blade being mounted at the free end of said manipulator.

The tapered blade affords the slotting of the strata material and the spreading the walls of the trough thus formed to a narrow width, the walls having a natural tendency to close in toward one another immediately after the passage of the blade. The spray manifold, carried by the blade and situated preferably in an open groove at the back of the blade, projects the product onto the material forming the walls of the notch at the moment when the walls close in toward one another. The scrapers fixed to the rear of the blade complete the refilling of the trough and level the upper surface of the treated strata. The scrapers and the treatment product spray manifold constitute along with the tapered blade a tool allowing the formation of a trough, the injection of a product and the refilling and levelling of the trough. Because the blade is fixed to the end of a pivoting manipulator, the width of the area taken up by the machine varies as a function of the progression of the blade, which avoids the machines constituting a prominent obstacle on the surface being treated during treatment.

BRIEF DESCRIPTION OF THE DRAWINGS

Other advantages and features of the invention will become evident with the following description in which reference is made to the accompanying drawings in which.

DETAILED DESCRIPTION OF THE INVENTION

Figure 1:
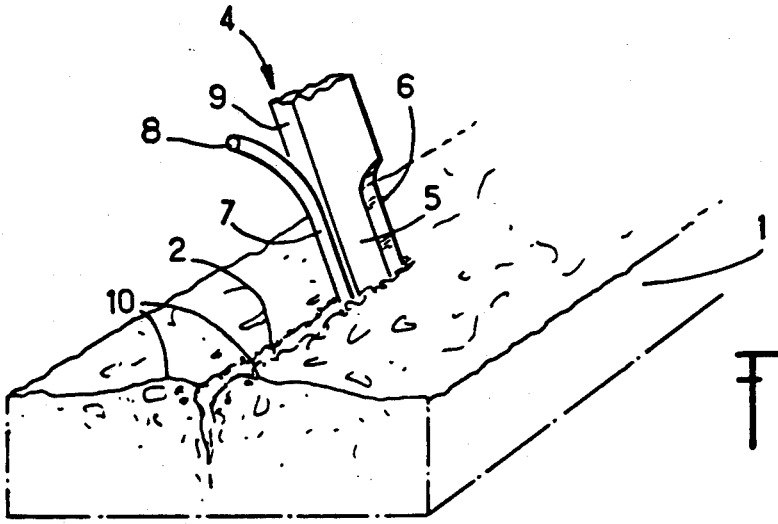
FIG. 1 is a schematic perspective view of the lower strata in which a trough is formed and the desired product is projected.
Figure 2:
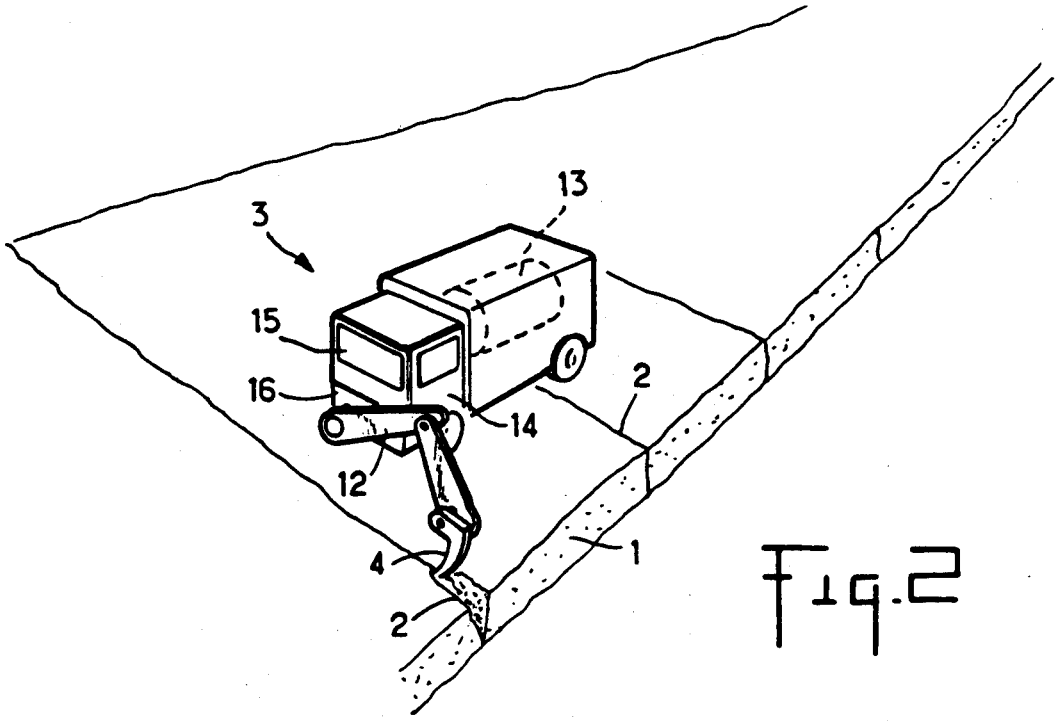
FIG. 2 is a schematic perspective view of the prefracturing apparatus according to the invention during the treatment of the lower strata of a pavement.

FIG. 1 shows the uppermost lower strata 1 generally of between 15 to 30 cm in thickness, formed of material (such as a granular material) treated with hydraulic binders. The stratum 1 receives, after compacting, the upper ballast layer of the pavement.

Troughs or notches 2 are formed in the freshly spread strata 1 (of granular material) before compacting of the strata, by means of a prefracturing machine 3 comprising, in particular, a tool 4 having a tapered blade 5 of triangular cross section of which the cutting edge 6 is positioned in the advancing direction of the blade 5. A spray manifold 7 for a product or binder 8 such as a bituminous emulsion, is provided on the rear edge or in a hollowed rear portion 9 of the blade 5 and has a row of ejection orifices 7*a* affording the distribution of the binder 8 over the entire height of the open trough behind the blade 5. These orifices can be equipped with spray nozzles forming flat or conical jets and projecting the product 8 into the trough 2 created by the blade 5. The trough 2 naturally recloses after the passage of the blade 5 which, by such passage forms mounds 10 of material on either side of the trough 2 and of the zone of the strata 1 impregnated with the product. The mounds 10 are levelled by two scrapers 11 forming an inverted V placed to the rear of the blade 5 and articulated on the upper portion of said blade 5 above a working portion thereof, by means of connecting arms 11*a* which cooperate with a spring 11*b* to continually urge the scrapers 11 against the surface of the strata 1.

The prefracturing machine 3 comprises several parts, each carrying out specific functions, including:

a tool 4, described hereinabove, for opening the trough 2, injecting the product 8 into the trough 2 and refilling the trough 2, an articulating manipulator 12 supporting the tool 4 and affording the penetration of the blade 5 of the tool 4 into the strata 1 material, as well as the progression of the tool 4 transversally to the pavement during the treatment phase and the repositioning of the tool 4 at the starting point of a new trough 2 after the transfer of the tool 4, a temperature controlled treatment product storage reservoir 13 for maintaining the reserve of product 8 at the utilization temperature thereof and for supplying product to the spray manifold 7 of the machine 4, a central hydraulic system 14 which transmits energy to the various parts of the prefracturing machine 3 and affords the control of the machine work cycle, and a support machine 15 which carries the manipulator 12, the reservoir 13, the central hydraulic system 14, and allows the displacement of the machine 3 about the work site, and of which the motor 16 serves as a primary energy source for the central hydraulic system 14.

Although the manipulator 12 described hereinafter is incorporated in a prefracturing machine 3, it should be borne in mind that such a manipulator 12 can be used with other machines and on other tasks and may carry various tools of other types, for example earth working tools etc.

The articulating manipulator 12 is supported at the front of a support machine 15 and comprises several elements adapted to pivot with respect to one another about horizontal axes perpendicular to the cutting plane of the blade 5. The first two members constitute beams 17 and 18 which in the particular case described wherein the forward end of the second beam 18 must move along a predetermined plane, are substantially equal in length. The two beams, 17, 18 pivot about a common pivot axis 19 situated at one end 17*b* and 18*b* of the beams 17 and 18. The first beam 17 called the command beam is adapted to pivot about an axis 20 fixed with respect to the support machine 15 and situated at the rear end 17*a* of the beam 17. At the forward end 18*b* of the second beam 18, called the follower beam, is provided a cradle 21 pivotable with respect to beam 18 about an axis 22, the cradle 21 constituting the third element of the manipulator 12.

The rear end 17*a* of the first beam 17 is coupled to the shaft 23 of a rotary hydraulic actuator 24 mounted on the chassis 25 of the support machine 15 by means of a bearing sleeve 20*a*. It will of course be understood that the rotary actuator 24 of which the output shaft 23 acts as the pivot shaft for the first beam 17, may be replaced by an articulating cylinder for instance a trunnion mounted pivoting cylinder supported at an elevated point on the chassis 25 and of which the shaft could be connected to the first beam 17 at a forward or median point thereon. The shaft 23 is coaxial with the pivot axis 20 of the first beam 17. In a similar way the second beam is coupled to a shaft 26 coaxial with the pivot axis 20 of the first beam 17. In a similar way the second beam is coupled to a shaft 26 coaxial with the pivot axis 19 of the two beams 17 and 18, and housed rotative within sleeves 27 mounted on the forward end 17*b* of the first beam 17, and the cradle 21 is coupled to a shaft 28 coaxial with the axis 22 and rotative within sleeves 29 provided at the forward end 18*b* of the second beam 18.

The beams 17 and 18 are hollow or may comprise I-beams.

A first gear 30 concentric with the shaft 23 and fixed to the chassis 25 of the support machine 15 is provided within the rear end 17*a* of the first beam 17. Another gear 31 situated within the forward end 17*b* of the first beam 17 is coupled to the shaft 26. The number of teeth and the diameter of the first gear 30 are, in the particular case described, the double of the number of teeth and of the diameter of gear 31.

A further gear, called the second gear, 32 concentric with and disposed about the shaft 26 is fixed to a lateral sleeve 17*c* provided at the forward end 17*b* of the first beam 17 and is placed within the rear end 18*a* of the second beam 18. The rear end 18*a* of the second beam 18 is fixed in rotation with respect to the shaft 26 which, for this, includes a lateral extension 26*a* which passes through the lateral sleeve 17*c* and supports a connecting flange 26*b* attached by means of a bolt 26*c* to the outer wall of the beam 18. The outer wall forms, at the rear end 18*a* a bearing support surrounding a portion of the extension 26*a* of the shaft 26 and projects partially into the annular space between said extension 26*a* and the lateral sleeve 17*c* in order to support the free end thereof. The other end of the lateral sleeve 17*c*, fixed to the first beam 17, comprises an annular shoulder serving as a pivot bearing for the inner wall of the second beam 18. A fourth gear 33 placed within the forward or frontal end 18*b* of the second beam 18 is coupled to the shaft 28. In the particular case described, the number of teeth and the diameter of the fourth gear 33 are the double of the number of teeth and of the diameter of the second gear 32, of which the number of teeth is identical to that of the gear 31, called the third gear.

A first endless chain 34, preferably provided with a tensioning means such as a screw means 36, links the first and third gears 30 and 31, whereas as a second endless chain 35, preferably also provided with a tensioning means such as a screw means 36, links the second and fourth gears 32 and 33.

The beams 17 and 18 and the cradle 21, the latter being fixed in rotation with respect to the shaft 28 of the fourth gear 33, are displaced during rotation of the shaft 23 in response to the rotary hydraulic actuator 24 in planes perpendicular to the axes 19, 20 and 22, which are horizontal and parallel to one another, the first beam 17 being displaced in a median plane 35*a* located in front of the support machine 15, the cradle 21 in a median plane 35*b* spaced from the front of the support machine 15, and the second beam 18 in a median plane 35*c* situated between the planes 35*a* and 35*b*, whereby the beams 17 and 18 and the cradle 21 do not encumber one another mutually in their respective movements.

The chains 34 and 35 are placed on the gears 30, 31, 32 and 33 such that when the first beam 17 is positioned vertically with the forward end 17*b* thereof extending upwardly, the second beam 18 is also vertical, the forward end 18*b* thereof extending downwardly adjacent the end 17*a* of the first beam 17. An arrangement of adjustable shoes 36 or screw type tensioning devices is provided for each of the spans of each chain 34, 35 affording adjustment of the chain tension and of the initial position of the beam 18 and of the cradle 21, particularly of the inclination of a reference surface of the latter, for example the rear face 21*a* with respect to a plane passing through the pivot axes 20, 22 of the first beam 17 and of the cradle 21 respectively.

By virtue of the fact that the beams 17 and 18 are of the same length between the axes 19, 20 and 19, 22 in the particular example described and that the first chain 34, which is looped about the first gear 30, brings about the displacement during rotation of the first beam 17 of the third gear 31 which has half as many teeth as the first gear and which is fixed in rotation to the second beam 18, and further because the fourth gear 33 has half as many teeth as the second gear 32, rotation of the first beam 17 about the pivot axis 20 thereof brings about the displacement of the second beam 18, whereby the bisector of the angle formed by the two beams 17 and 18 remains perpendicular to the plane passing through the two end axes 20 and 22 of the beams 17 and 18. Furthermore, the shaft 28 is displaced in a plane parallel to the support plane of the support machine 15, which in the present case, is none other than the upper surface of the strata 1, and thus remains at a predetermined distance above the strata 1. The cradle 21, fixed with respect to the fourth gear 33, remains in a given orientation with respect to the plane passing through the end axes 20 and 22 of the manipulator throughout the translation of the shaft 28.

The shaft 28, and more generally the forward end **18*b* of the second beam 18 can be displaced over a total length equal to four times the distance separating the axes 19 and 20, or the axes 19 and 22, between a first outer position in which the beams 17 and 18 extend horizontally toward one side of the support machine 15 and a second outer position in which the beams 17 and 18 extend horizontally toward the opposite side of the support machine 15. The maximum displacement is reduced to one half if the first beam 17 cannot pivot 180°, that is cannot pass in front of the support machine 15**, and therefore can rotate only 90° between the maximum vertical position and the outer horizontal position thereof.

The cradle 21 comprises a vertical plate 37 perpendicular to the shaft 28. A tool support 38 in the form of a lever is mounted by the rear end thereof rotative on a pivot 39 parallel to shaft 28 of the forward end **18*b* of the second beam 18, the pivot 39 being fixed to the lower rear portion of the vertical plate 37. The tool support in the form of a lever 38 is maintained in a predetermined position with respect to the cradle 21 and the plate therefor 37 by means of a trunnion mounted cylinder 40 pivotable on the upper portion of the vertical plate 37 and the shaft of which is connected to a clevice pin 41 placed generally near the centre of the tool support lever 38 between an upper rest position (represented by the phantom line in FIG. 3) and a lower work position such as indicated by solid lines in FIG. 3. Furthermore the cylinder maintains a constant force on the tool support 38 while allowing the latter to rock upwardly should the tool 4 encounter an unforseen obstacle which would otherwise damage the tool. The cradle 21, the tool support 38 and the tool 40, which are fixed in rotation to the fourth gear 33 maintain their initial orientation throughout the translation of the forward end 18*b* of the second beam 18 as the pivot axes 20 and 22** are brought together or separated.

The tool 4 is preferably attached to the end of the tool support 38 distal from the pivot 39, with shock absorbers 42 such that the cutting plane of the blade 5 is vertical.

Figure 7:
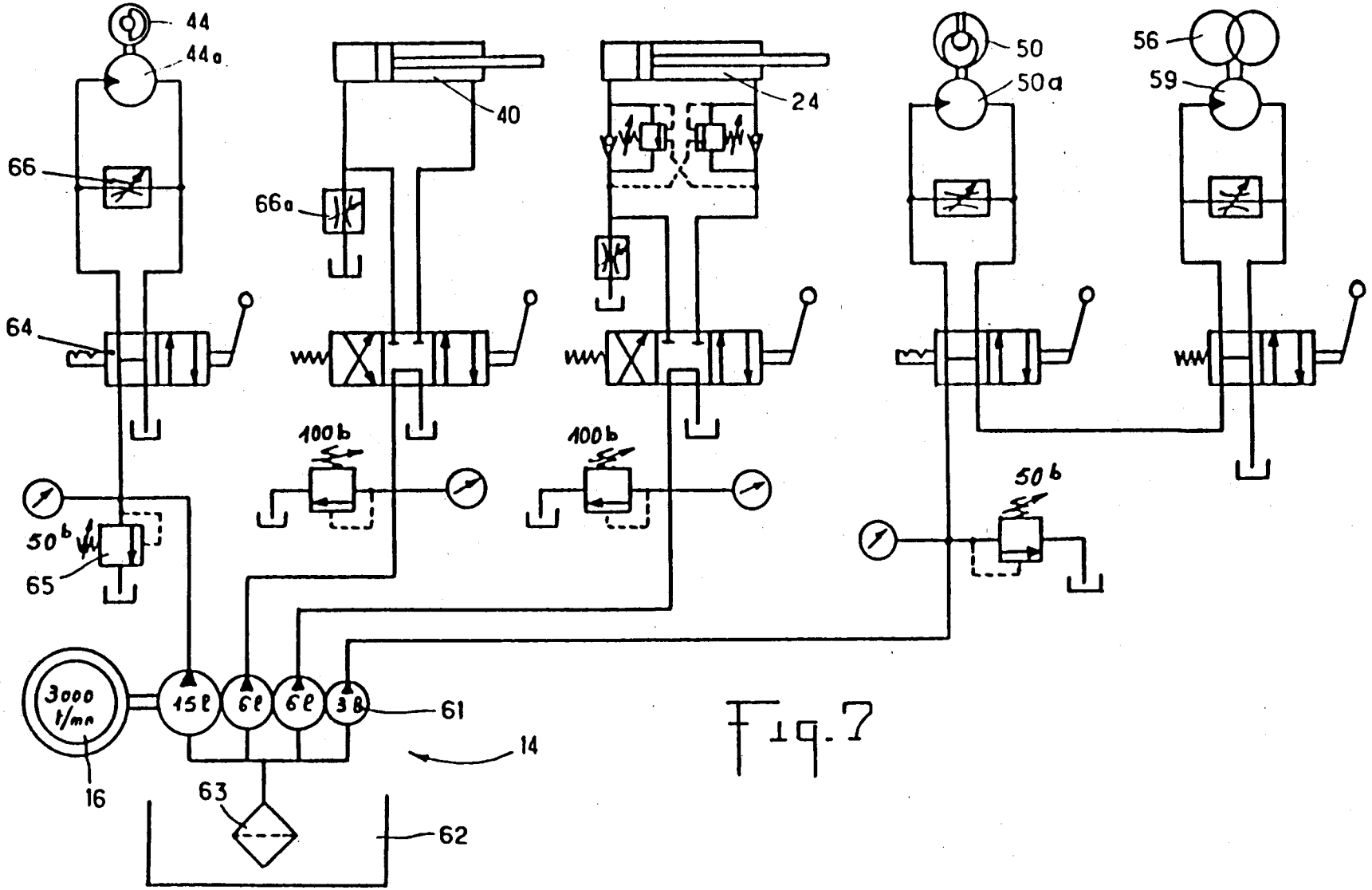
FIG. 7 is a circuit diagram for the central and other hydraulic circuits of the machine.

On the upper part 43 of the tool 4 is placed, if desired, a vibration generator 44 comprising a horizontal shaft 45 mounted on a roller bearing and driven by a hydraulic motor **44*a* (see FIG. 7). The shaft 45 carries eccentric counter weights 46, the rotation of which causes oscillations of an amplitude and a frequency which are a function of the speed of rotation of the shaft 45 and of the mass of the eccentric counter weight 46. The vibrations afford improved penetration of the tool 4 into the material comprising the strata 1 and facilitate the advance of the tool 4 during the opening of the trough 2**.

Figure 3:
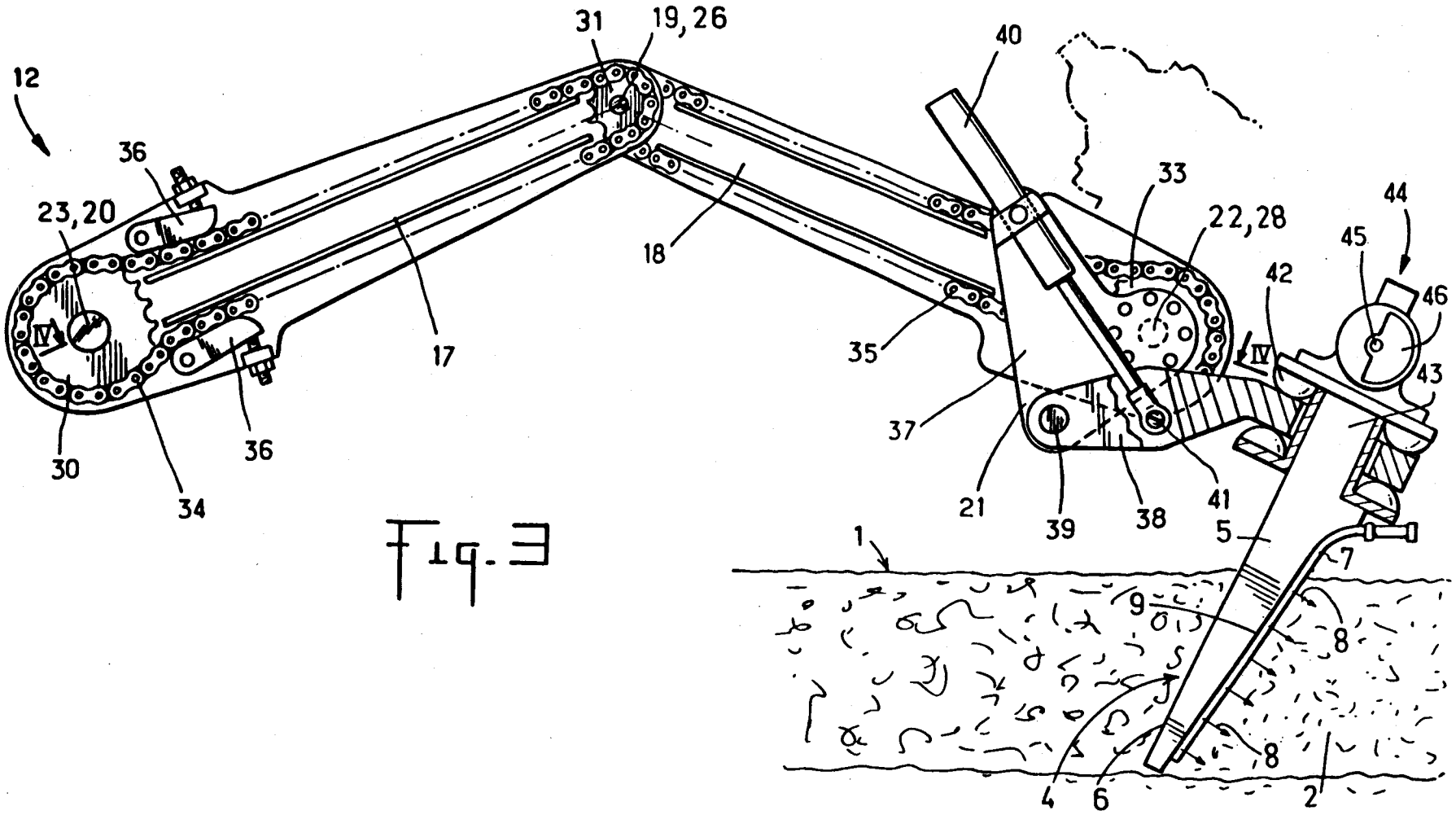
FIG. 3 is a vertical sectional view of a manipulator and of a tool according to the invention, taken along line III—III of FIG. 4.
Figure 4:
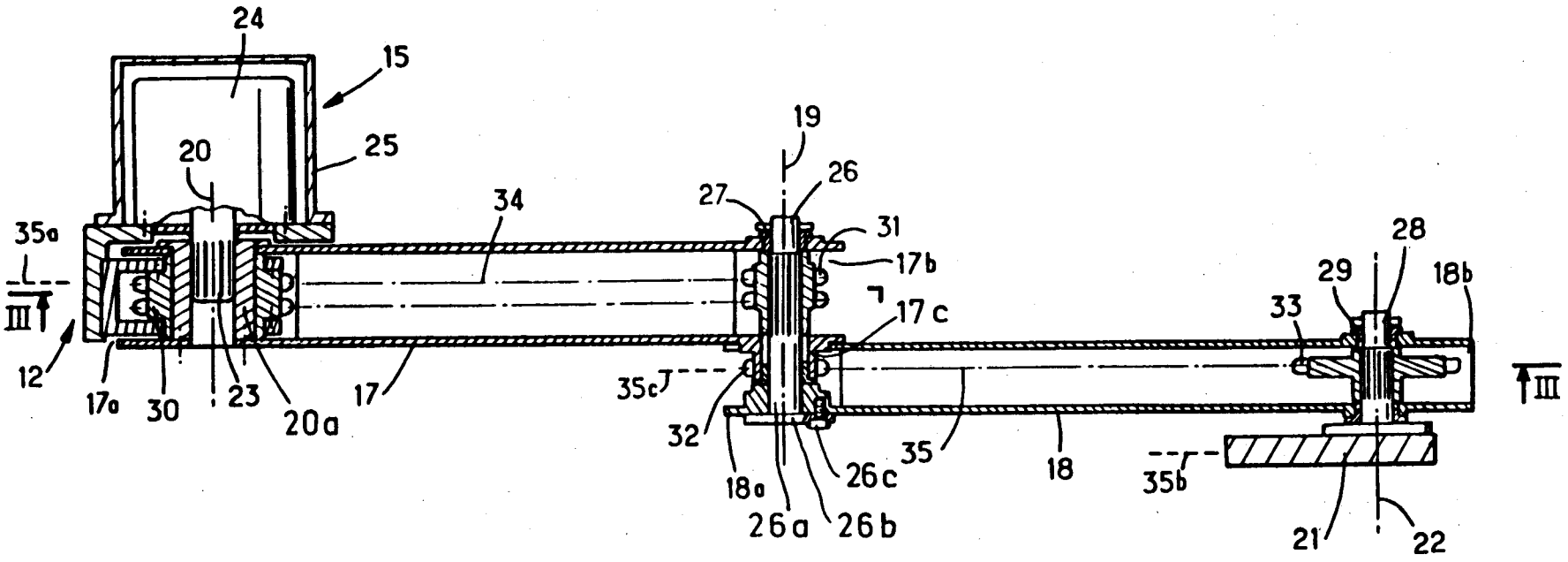
FIG. 4 is a sectional view of the manipulator taken along line IV—IV of FIG. 3.
Figure 5:
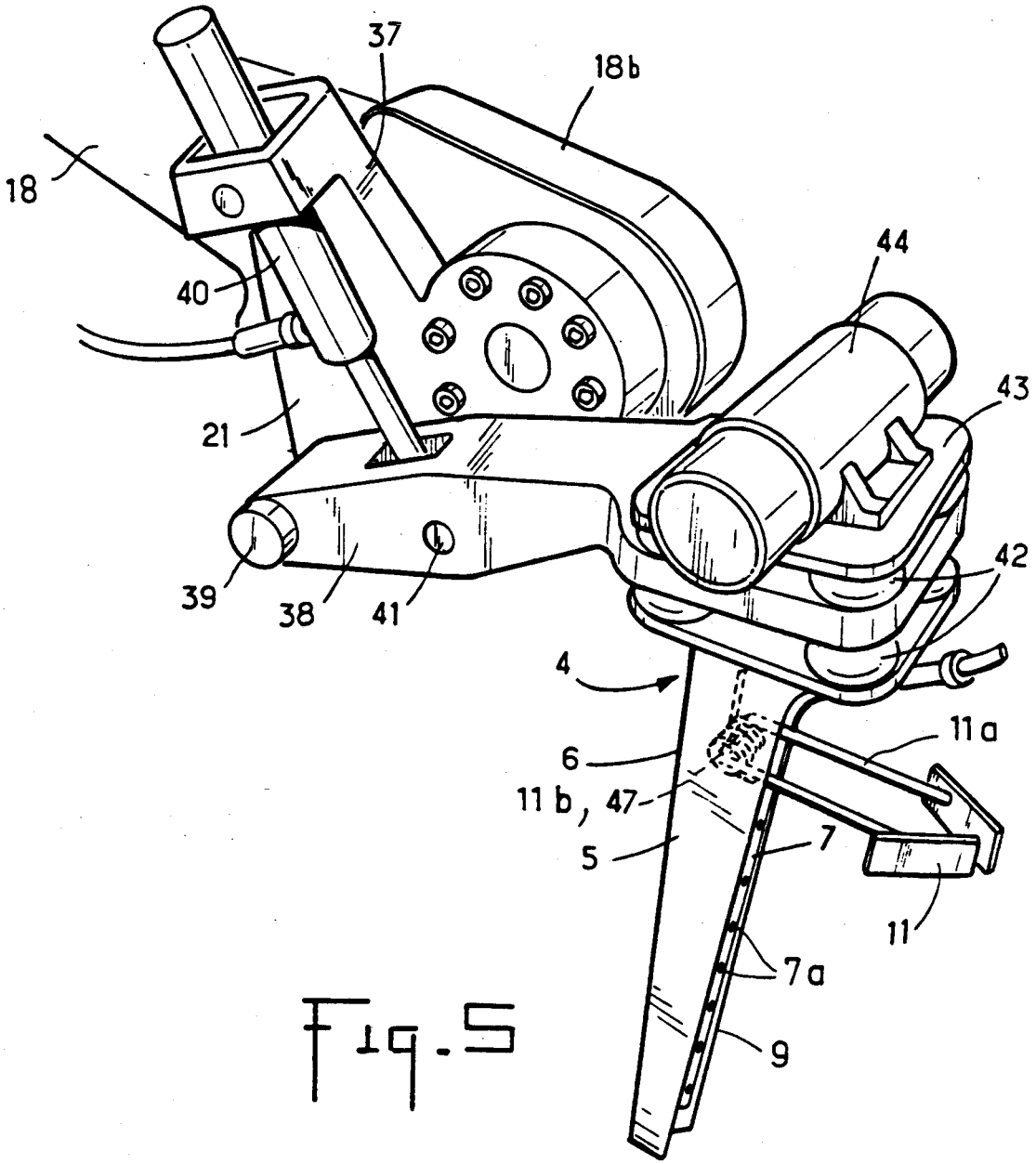
FIG. 5 shows, in perspective, the attachment of the blade to the mobile end of the manipulator.
Figure 6:
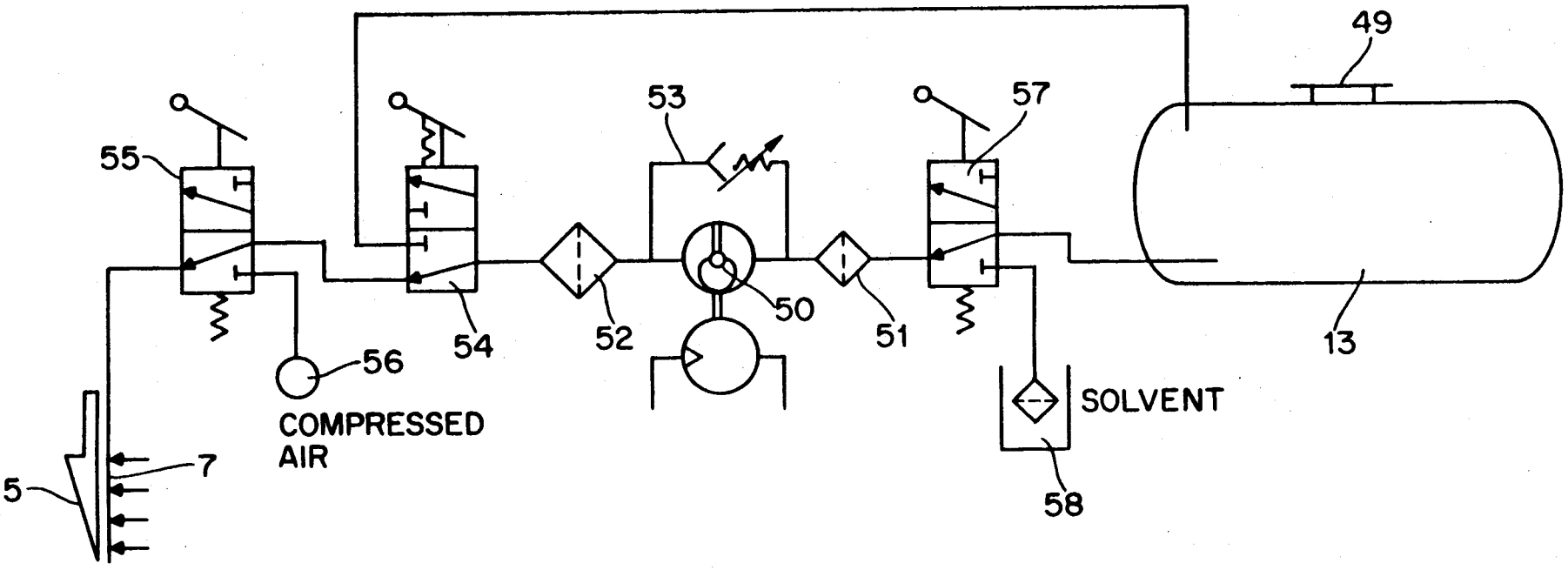
FIG. 6 is a circuit diagram for the treatment product.

When, after a work cycle, the tool 4 has treated a trough over the entire width of the pavement, the tool 4 is raised by means of the cylinder 40 which causes the tool support 38 to pivot upwardly about the pivot axis 39 thereof in a counter clockwise direction as shown in FIG. 3. The support machine is then moved several meters (e.g. 3.5 m). The tool 4, in transfer position, that is in the raised position, is brought to the starting point of a new trough by means of the hydraulic rotary actuator 24 which causes the first beam 17 to pivot whereby the tool support 38 assumes its most distal position with respect to the pivot shaft 23 of the first beam 17 and in which the cutting edge 6 of the tool 4 is turned toward said shaft 23. The tool 4 is then brought into its work position, that is, rocked downwardly about the pivot 39 in a clockwise direction in FIG. 3, whereby the blade 5 is substantially vertical or slightly inclined from top to bottom in the tool cutting direction, by means of the cylinder 40, and the first beam 17 is then pivoted upwardly about the axis 20 in a counter clockwise direction, by the rotary hydraulic actuator 24, thereby forming a trough 2, treating the material or aggregate bordering said trough 2 and refilling and levelling the trough 2 by the tool 4.

During the work phase of the tool 4, the scrapers 11 articulated on the upper part of the blade 5 above the orifices **7*a* of the spray manifold 7 are applied against the surface of the strata 1 by tortion springs 11*a*, 47 allowing the scrapers to adapt to the thickness of the strata. The treatment product 8 is injected by the spray manifold 7 only during the tool work phase. During the tool transfer phase when the tool 4 is in its raised position the vibration generator 44** may be stopped, although this is not obligatory.

The product 8 projected onto the walls of the open trough 2 by the spray manifold 7 placed at the rear of the tapered blade 5 and preferably in a hollowed portion thereof, is held in a horizontal cylindrical reservoir 13 with domed endcaps, and a quick closing fill opening 49. The reservoir 13 is equipped with necessary accessories for the correct operation of the system: a float type level indicator, a dial type thermometer, a pressure limiting valve, a drain valve and piping. The reservoir is furthermore enclosed in a thermal insulation jacket. The product 8 held in the reservoir 13 is drawn into a radial piston type positive displacement pump 50 provided with a replaceable element prefilter 51 and filter 52 and a relief valve 53 to limit output pressure. The product 8 is transferred to the spray manifold 7 by means of three-way valves. The first valve 54 permits the product to be recycled to the reservoir 48 during the transfer or return of the tool 4. The second valve 55 is used to purge the spray manifold 7 after utilization, by the introduction of compressed air furnished by a compressor group 56. A third valve 57 placed between the reservoir 13 and the positive displacement pump 50 permits the switching of the pump inlet to a solvent reservoir 58 in order to clean the entire circuit, that is, the filters 51 and 52, the positive displacement pump 50 and the valves 54 and 55.

The various motors and hydraulic actuators, that is the hydraulic rotary actuator 24, the hydraulic motor **44*a* driving the vibration generator 44, the hydraulic motor 50*a* driving the positive displacement pump 50, the hydraulic motor 59 for the compressor group 56 and the cylinder 40 which determines the initial position and the penetration depth of the tapered blade 5 into the strata material, are supplied with fluid from a central hydraulic unit 14 provided on the support machine 15 and driven by the motor 16 of the support machine 15. The central hydraulic unit 14** comprises a multistage pump 61, a fluid reservoir 62, equipped with strainers 63, filters, a level indicator, a thermometer, a poppet valve and directional control valves 64 for controlling each movement and function and allowing for automation of the work cycle by means of a programmable controller, as well as pressure and flow regulating valves 65 and 66.

It is worth noting that if in the course of the work cycle, the blade 5 encounters an unforeseen obstacle, a pressure in excess of a predetermined pressure occurs in the cylinder 40 following the rocking of the blade about the pivot 39, and the pressure limiting valve 66*a* allows the blade 5 to rock upwardly by channelling fluid from the cylinder 40 directly to the fluid reservoir 62.

The support machine 15 is equipped with wide treaded tires so as to allow for movement on non-compacted strata of material. The support machine furthermore has a short wheel base and a rotating front axle in order to provide ease of manouvering. The support machine also afforts stability to the prefracturing machine 3 without the need for retractable outriggers due to the width of the wheelbase and to the suspension which is furnished solely by the compressibility of the tires. The weight of the support machine counteracts the forces developed by the movement of the manipulator 12 and the penetration of the tool in the strata material. As has been pointed out, the support machine 15 carries the entire prefracturing machine 3 in such a way as to form a totally autonomous unit, occupying a limited space, and of which the engine 16 drives the transmission for the normal displacement of the vehicle as well as the multi-stage pump 61 of the central hydraulic unit 14.

The maximum length of the trough 2 is equal to four times the distance separating the axes 19 and 20, or 19 and 22, of the beams of the manipulator 12. It will be appreciated that the length of a trough is limited by the length of the pavement surface. For this reason the prefracturing machine 3 is provided with a programmable controller affording the automatic control of the machine work cycle, as a function of the width of the pavement and of the thickness of the strata to be treated. The programmable controller controls the rotary hydraulic actuator 24 so as to limit the rotation of the command beam 17, and the cylinder 40 controlling the depth of penetration of the tapered blade 5 into the strata 1.

According to another embodiment of the prefracturing machine 3, the first beam 17 called the command beam can be pivoted by a hydraulic cylinder articulated on the chassis 25 of the support machine 15, for instance at one end of the barrel of the cylinder and on the first beam 17 at a suitable distance from the pivot axis 20, for example by the cylinder rod.

The manipulator described in reference to the prefracturing machine may obviously be incorporated in any other machine in which a tool supported on the cradle of the manipulator must, in operation, be displaced in such a way as to effect a back and forth translational movement lineally or along a predetermined curve. The command beam 17 of the manipulator 12 may in such a case be mounted on a mobile support unit or on a fixed support.

Figure 8:
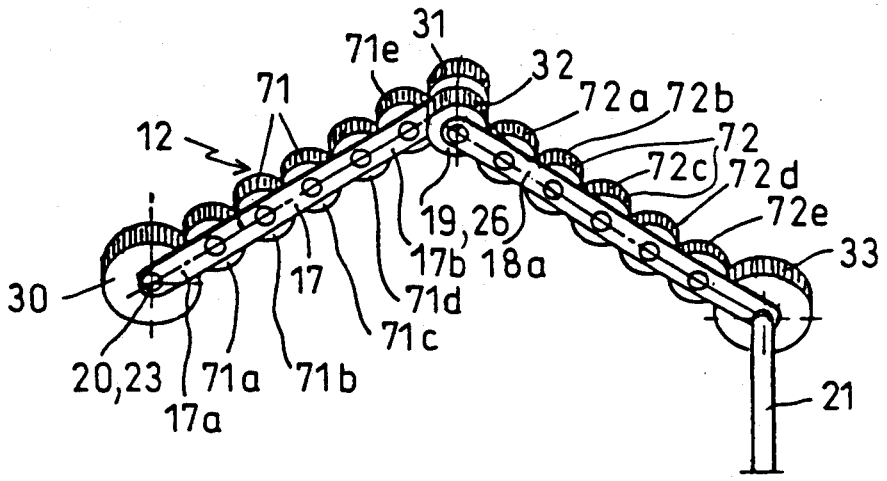
FIGS. 8 and 9 are perpectively schematic elevation and plan views of a second embodiment of the manipulator and, FIG. 10 shows a perspective view of a support system for the rear of the manipulator affording to the latter complete liberty of movement.
Figure 9:
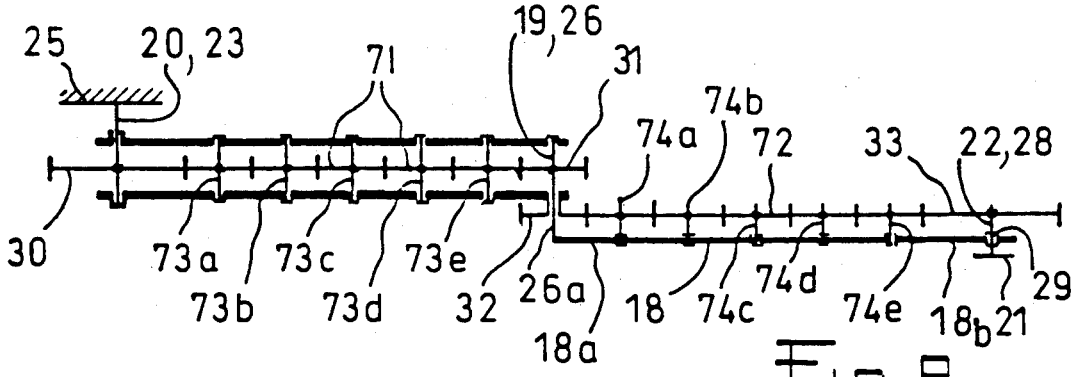

FIGS. 8 and 9 represent schematically a further embodiment of the manipulator 12 respectively in elevation (FIG. 8) and in plan view (FIG. 9).

The manipulator 12 in this embodiment includes a command beam 17 pivoted at its rear end 17*a* about an axis 20 supported on the chassis 25 of the support machine 15. This axis may constitute an output shaft 23 of a pivot motor 24. In such a case, the rear end 17*a* of the command beam 17 is coupled to the output shaft 23 whereby the command beam 17 pivots with the shaft 23 about the axis 20. As has already been mentioned, the rotational movement of the command beam 17 about the axis 20 fixed in rotation can also be effected by means of a cylinder of which the barrel or the rod is articulated on the chassis 25 and of which inversely the rod or the barrel is articulated on the command beam 17, the two articulation points being sufficiently separated from the pivot axis 20.

At the axis 20 or about the shaft 23 is coaxially placed a first gear 30 which is stationary in rotation and fixed with respect to the axis 20 and to the chassis 25. If this first gear 30 is mounted about the output shaft 23, a bearing sleeve is preferably included between the gear 30 and the shaft 23 in order to reduce friction between these elements during rotation of the shaft 23.

As in the preceding example the forward end 17*b* of the command beam 17 is provided with a gear 31 coupled to the shaft 26 housed within suitable bearings at the forward end 17*b* of the command beam 17. The shaft 26 is extended laterally and outwardly by shaft extension 26*a* to which is fixed in rotation the rear end 18*a* of the follower beam 18, the axis 19 of the shaft 26 constituting the common pivot axis of both beams 17 and 18 of the manipulator 12.

The second gear 32 is mounted on the shaft extension 26*a* and cannot rotate with respect to shaft 26 due to the fact that it is attached to the lateral face of the forward end 17*b* of the command beam 17.

The fourth gear 33 is coupled to shaft 28 housed within bearings 29 at the forward end 18*b* of the follower beam 18, the shaft 28 having an extension which protrudes laterally from said beam 18, and on which is mounted the cradle 21 which therefore rotates with shaft 28 about the axis 22 thereof.

As in the preceding example the axes 19, 20 and 22 of shafts 26, 27 and 28 respectively are parallel to one another and the first and fourth gears 30 and 33 have the same diameter and the same number of teeth while the second 32 and third 31 gears and mounted about the common axis 19 have the same diameter and the same number of teeth, but wherein the diameter and the number of teeth of said second and third gears 32, 31 are only half of the diameter and of the number of teeth of the first and fourth gears 30 and 33.

In order to connect the first gear 30 to the third gear 31 and the second gear 32 to the fourth gear 33 a series of intermediate gears 71 and 72 may be used in place of the endless chains 34 and 35.

In such case, each series of intermediate gears 71 and 72 comprises an odd number of gears 71*a*, 71*b*, 71*c*, 71*d*, 71*e* and 72*a*, 72*b*, 72*c*, 72*d*, 72*e* meshing with one another and mounted in free rotation upon shafts 73*a* to 73*e* and 74*a* to 74*e* respectively supported by the command beam 17 and the follower beam 18. During the rotation of the command beam 17, the first intermediate gear 71*a* of the first series 71 cooperates with the first gear 30 fixed to the chassis 25 by moving about the periphery of first gear 30 rotating about the axis of its respective shaft 73*a* and transmitting its rotational movement to the next intermediate gear 71*b* and so forth, whereas the last intermediate gear 71*e* of the first series 71 meshes with the third gear 31 transmitting thereto its rotational movement. In a similar way, during the rotation of the follower beam caused by the rotation of the command beam 17 and by the shaft 26, the first intermediate gear 72a of the second series 72 moves along the periphery of the second gear 32, turning about the axis of its corresponding shaft 74a and transmitting its rotational movement to the next intermediate gear 72b and so forth, whereas the last intermediate gear 72e of the second series 72 cooperates with the fourth gear 33 in order to impart thereon and on the cradle which is attached thereto a rotational movement of which the angle is proportional to the angle of rotation of the command beam 17 and depends firstly, upon the ratio of the lengths of the beams 17, 18 between the axes 20, 19 and 19,22 respectively and secondly, upon the ratio of the diameters and the number of teeth of the gears 30 to 33 provided at the ends of the beams 17, 18.

If the lengths of the beams 17, 18 are equal and if the ratio between the diameters and the number of teeth of the first gear 30 and the third gear 31 is equal to 2:1, the forward end 18b of the follower beam 18 will be displaced along a linear trajectory independent of the rotational angle of the command beam 17. If furthermore, the ratio between the diameters and the number of teeth of the second gear 32 and the fourth gear 33 is equal to 1:2 and if, as is preferably the case, the diameters and the number of teeth respectively of the second 32 and third 31 gears are identical, the cradle 21 will maintain its initial inclination with respect to the linear path of the forward end 18b of the follower beam 18 independent of the rotation of the two beams 17, 18.

Thus the pivot axes 19, 20, 22 define three points of an isoceles triangle of which the two equal sides and the included angle (situated at axis 19) are defined by the command beam 17 and the follower beam 18. The angle of rotation of the follower beam 18 with respect to the command beam 17 is then, the double of the angle of rotation of the latter. Furthermore, the angle of rotation of the cradle with respect to the follower beam 18 is identical to the angle of rotation of the command beam 17. Thus the tool 4 fixed to the cradle 21 maintains its initial inclination with respect to the trajectory of the tool 4 throughout the displacement thereof. The bisector of the included angle of the isoceles triangle defined by the two beams 17, 18 of equal length is therefore always in a vertical position throughout the rotational movement of the beams 17, 18. It follows that the base of the same triangle, of variable length, is constantly maintained horizontal.

In order to allow the forward end 18b of the follower beam 18 to be displaced in planes inclined with respect to the horizontal or to change the level of the displacement plane with respect to a reference plane, the rear end 17a of the command beam 17 is advantageously mounted on a pivot yoke or clevis 75 which is itself supported on a universal joint type support 76 allowing the yoke to pivot about three axes X, Y, Z of a Cartesian coordinate system. The support 76 is schematically represented in FIG. 10.

Figure 10:
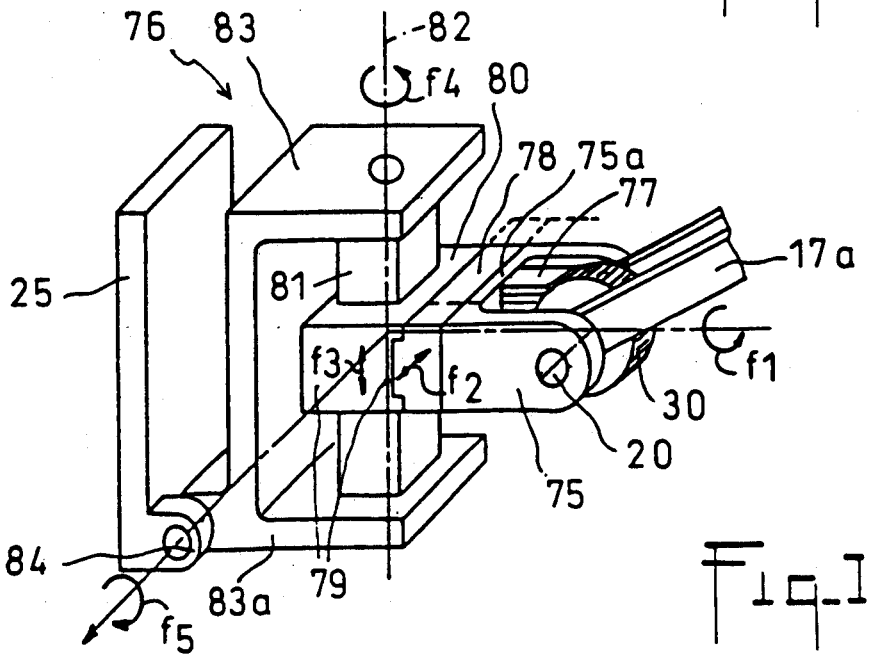

As can be seen in FIG. 10, the pivot yoke 75 carries the pivot pin 20 of the rear end 17a of the command beam 17 which is pivoted by means of a cylinder (not shown). Furthermore, the first gear 30 is provided on the pivot pin 20 and is held stationary in rotation by a blocking device 77 which is form fit to the rear portion of said first gear 30 and attached to the rear flange 75a of the yoke 75.

Opposite the pivot pin 20, the rear flange 75a is mounted on a first carriage 78 by means of a rotational bearing (not represented) which allows the yoke to rotate (see the arrow f1 in FIG. 10) about an X axis perpendicular to the axis of pivot pin 20 and to the rear flange 75a of the yoke. It will be appreciated that the rotational bearing is associated with locking means (not represented) affording adjustment of the yoke 75 in any desired angular position about the X axis.

The first carriage 78 is mounted moveable in translation on a slide 79 so as to be able to move parallel to the axis of pin 20 and to the Y axis of the Cartesian coordinate system (see the arrow f2 in FIG. 10). The slide 79 is formed in a second carriage 80 which is mounted movable (see the arrow f3 in FIG. 10) on a slide bar 81 which extends perpendicular to the plane defined by X and Y axes, and which is adapted to rotate (see the arrow f4 in FIG. 10) about the axis 82 which coincides with the Z axis of the Cartesian coordinate system.

The ends of the slide bar 81, along the rotational axis 82, are mounted between the lateral flanges of a second yoke 83, which is mounted by the lower flange 83a thereof pivotable on a pin 84 fixed to the chassis 25 of the support machine. The axis of pin 84 is parallel to that of pin 20 supported in the pivot yoke 75, and allows the latter as well as the second yoke 83, to pivot about an axis parallel to the Y axis of the Cartesian coordinate system defined by axes X, Y and Z (see the arrow f5 in FIG. 10).

The upper portion of the lower flange 83a of the second yoke 83 as well as the upper portion of the command beam 17 are each connected at a suitable point to the chassis 25 by means of a cylinder. It will be understood that alternatively a cylinder may be provided between the upper portion (upper flange) of the second yoke 83 and the upper portion of the command beam 17 in order to control the rotation of the latter.

Thus the command beam 17 is afforded total liberty of movement. It will be understood by one skilled in the art that one or several of the degrees of movement may be eliminated as a function of the needs or objectives to which the manipulator must respond.

In the foregoing only mechanical means have been described for linking the angular displacement of the command beam 17 to that of the follower beam 18 and the angular displacement of the latter to that of the cradle 21 of the tool 4.

These mechanical means, each associated with the two beams 17, 18, fulfill three functions:

a. the detection of the degree of angular rotation of the first and second beams 17, 18;
b. the transmission of detected information to a rotational motor acting upon the pivot shaft of the second beam 18 and of the cradle 21; and,
c. the rotation of the second beam 18 and of the cradle 21 through an angle proportional to the angle rotation of the first beam 17.

It will be readily understood that these functions can be equally well fulfilled by means which are not purely mechanical, such as optical, electrical and/or electronic means.

In this way, the means for detecting the rotational angle of each of the beams 17, 18 could be optical type means, the means for transmission could be electronic or electrical, and the driving motor for beam 18 or for cradle 21 could be an electrical step motor controlled by signals which would be transmitted thereto by electrical or electronic means.

What is claimed is:

1. A manipulator for a public works machine comprising at least one arm having a first end and a second end, said first end being pivotably supported on a chassis of the public works machine and said second end being provided with a tool mounted to rotate about an axis of said second end of said arm; and, control means for positioning said manipulator and said tool;

wherein said manipulator comprises a command beam and a follower beam, each beam having a rear end and a forward end, said command beam being pivotable at the rear end thereof about a first pivot axis fixed with respect to said chassis and said command beam further being pivotable with respect to said follower beam about a second pivot axis common to both beams, the forward end of said follower beam being provided with a cradle mounted to rotate thereon about a third pivot axis;

wherein each beam includes a means for detecting the angle of rotation thereof, and a rotative motor supported by the forward end of the respective beam with the rotative motor of the command beam being supported by said command beam to provide rotation of said follower beam and the rotative motor of said follower beam being supported by said follower beam to provide rotation of said cradle, transmission means on each beam between the detecting means and the rotative motor of the respective beam, the transmission means of the command beam controlling the rotation of the follower beam as a function of the angle of rotation of the command beam as detected by the detecting means thereof, and the transmission means of the follower beam controlling the rotation of the cradle as a function of the angle of rotation of the follower beam as detected by the detecting means thereof, and a further rotative motor mounted to rotate the command beam about the first pivot axis.

2. A manipulator according to claim 1, wherein the detecting means, the rotative motor and the transmission means provided between the detecting means and the rotative motor of each beam are mechanical elements.

3. A manipulator according to claim 2, wherein the detecting means of said command beam comprises a first gear mounted about said first pivot axis and fixed in rotation with respect to said chasis, and the detecting means of said follower beam comprising a second gear mounted about said second pivot axis and fixed in rotation with respect to said command beam; and, wherein said rotative motor supported on the forward end of said command beam comprises a third gear coupled to a pivot shaft fixed to said rear end of said follower beam and coaxial with said second pivot axis, and said rotative motor supported on the forward end of said follower beam comprises a fourth gear coupled to a pivot shaft fixed to said cradle and coaxial with said third pivot axis.

4. A manipulator according to claim 3, wherein said transmission means provided between said detecting means and said rotative motor of said command beam comprises an endless chain engaging said first and third gears, and said transmission means provided between said directing means and said rotative motor of said follower beam comprises an endless chain engaging said second and fourth gears.

5. A manipulator according to claim 3, wherein said transmission means of with each of said beams comprises a series of an odd number of intermediate gears supported on each respective beam about parallel rotational axes whereby each gear in each of said series engages the successive gear in said series, the first and last intermediate gears in the series of intermediate gears supported by said command beam engaging said first and third gears respectively, and the first and last intermediate gears in the series of intermediate gears supported by said follower beam engaging said second and fourth gears respectively.

6. A manipulator according to claim 3, wherein the ratio of the number of teeth of the first and third gears respectively is 2:1 and the ratio of the number of teeth of the second and fourth gears respectively is 1:2.

7. A manipulator according to claim 1, wherein the length of the command beam between said first and second pivot axes is equal to the length of the follower beam between said second and third pivot axes.

8. A manipulator according to any one of claims 1 through 7, wherein said rear end of said command beam is supported on a first pivot pin in a first yoke fixed to a carriage, said carriage being mounted on a universal support, and said universal support being mounted rotative on said chassis of said support unit by means of a second pivot pin of which the central axis is parallel to the central axis of said first pivot pin.

9. A machine for prefracturing of lower strata of a pavement treated with hydraulic binders including:

a chassis, a manipulator comprising a command beam and a follower beam, each having a rear end and a forward end, said command beam being pivotable at the rear end thereof about a first pivot axis fixed with respect to said chassis and said command beam further being pivotable with respect to said follower beam about a second pivot axis common to both beams, the forward end of said follower beam being provided with a cradle mounted thereon about a third pivot axis, wherein each beam includes means for detecting the angle of rotation thereof and a rotative motor supported by the forward end of the respective beam with the rotative motor of the command beam supported by said command beam to provide rotation of said follower beam, and the rotative motor of said follower beam supported by said follower beam to provide rotation of said cradle; transmission means on each beam between the detecting means and the rotative motor of the respective beam, the transmission means of the command beam controlling the rotation of the command beam as detected by the detecting means thereof, and the transmission means of the follower beam controlling the rotation of the cradle as a function of the angle of rotation of the follower beam as detected by the detecting means thereof;

a motor for pivoting said command beam about said first pivot axis;

means for forming troughs including a tapered blade, of triangular cross section having a cutting edge and a rear edge, the cutting edge being placed in the direction of movement of the blade during treatment of the strata;

means for projecting a product in said troughs including a spray manifold attached to the rear edge of the tapered blade and connected to a pump for drawing treatment product held in a reservoir;

means for refilling and levelling said troughs including two scrapers flexibly mounted on the rear edge of the blade and forming a V shape opening in the direction of movement of the blade during treatment of the strata, wherein, the blade, the manifold and the scrapers are combined so as to form a single tool mounted on the cradle of said manipulator; and, means for displacing said manipulator, said trough forming means, said projecting means and said refilling and levelling mean during operation of the prefracturing machine.

10. A machine according to claim 9, wherein said blade is supported on said cradle by means of a tool support arm having a distal end a proximal end and mounted at said proximal end rotative about a pin fixed to said cradle and having a central axis parallel to said first pivot axis of said command beam, said blade being mounted at said distal end of said tool support arm, and wherein a cylinder is provided on said cradle for causing movement of said tool support arm, whereby said blade may assume a work position in which the blade is substantially vertical and penetrates into the pavement lower strata, and a transfer position in which the blade is raised.

11. A machine according to claim 10, wherein a vibratory device is interposed between the tool support arm and the blade.

* * * * *

UNITED STATES PATENT AND TRADEMARK OFFICE

CERTIFICATE OF CORRECTION

PATENT NO. : 5,070,286

DATED : December 3, 1991

INVENTOR(S) : Soulard et al.

It is certified that error appears in the above-identified patent and that said Letters Patent is hereby corrected as shown below:

Col. 2, line 29, "relates" should read --relates to--;

Col. 2, line 32, "trough is" should read --trough--;

Col. 2, lines 38-39, "bitumous cationic emultion" should read --bituminous cationic emulsion--;

Col. 2, line 40, "roll" should read --role--;

Col. 2, line 40, "pH" should read --low ph--;

Col. 2, line 40, "aqueuse" should read --aqueous--;

Col. 2, line 58, "ridgidly" should read --rigidly--;

Col. 2, line 62, "emultion" should read --emulsion--;

Col. 3, line 42, "spreading" should read --spreading of--;

Col. 6, line 27, "whereas as" should read --whereas--;

UNITED STATES PATENT AND TRADEMARK OFFICE

CERTIFICATE OF CORRECTION

PATENT NO. : 5,070,286

DATED : December 3, 1991

INVENTOR(S) : Soulard et al.

It is certified that error appears in the above-identified patent and that said Letters Patent is hereby corrected as shown below:

Col. 7, line 44, "unforseen" should read --unforeseen--;

Col. 8, line 25, "tortion" should read --torsion--;

Col. 13, line 48, "chasis" should read --chassis--;

Col. 14, line 2, "of with each" should read --of each--;

Col. 15, line 13, "mean" should read --means--; and

Col. 16, line 1, "a proximal end" should read --and a proximal end--.

Signed and Sealed this

Nineteenth Day of October, 1993

Bruce Lehman

*Attest:*

BRUCE LEHMAN

*Attesting Officer*

*Commissioner of Patents and Trademarks*